US008276905B2

(12) United States Patent
Suzuki

(10) Patent No.: US 8,276,905 B2
(45) Date of Patent: Oct. 2, 2012

(54) SHEET FEEDING APPARATUS AND IMAGE FORMING SYSTEM

(75) Inventor: Tomoo Suzuki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/961,872

(22) Filed: Dec. 7, 2010

(65) Prior Publication Data

US 2011/0140344 A1 Jun. 16, 2011

(30) Foreign Application Priority Data

Dec. 10, 2009 (JP) ..... 2009-280213
Apr. 7, 2010 (JP) ..... 2010-088502

(51) Int. Cl.
*B65H 3/14* (2006.01)

(52) U.S. Cl. ..... 271/98; 271/104; 271/97; 271/94

(58) Field of Classification Search ..... 271/98, 271/104, 94, 97, 106, 12
See application file for complete search history.

(56) References Cited

U.S. PATENT DOCUMENTS 5,654,274 A * 8/1997 Kari ..... 514/3.7
7,913,993 B2 * 3/2011 Kosugi et al. ..... 271/98
8,042,798 B2 * 10/2011 Suzuki ..... 271/98
2008/0061493 A1 * 3/2008 Weaver et al. ..... 271/94

FOREIGN PATENT DOCUMENTS

JP 62-16944 A 1/1987
JP 6-199438 A 7/1994

* cited by examiner

*Primary Examiner* — Luis A Gonzalez
(74) *Attorney, Agent, or Firm* — Cantor Colburn LLP

(57) ABSTRACT

A sheet feeding apparatus including: a sheet loading table; and an adsorption conveyance section having: multiple belts with through-holes; and an air suction section in an inside of the belts and absorbs air through the through-holes; wherein the conveyance section sucks air, allows the sheet to be adsorbed to the belt, and conveys it; the adsorption conveyance section further includes: a first roller provides driving force to the belts; a second roller rotated by the belts, and a third roller between the first roller and the second roller and rotated by the belts, and the belts are supported by those rollers; and an outer surface of the belts mostly protrudes towards the sheets on the table at a central part of the third roller in a cross section perpendicular to the conveyance direction containing a shaft of the third roller.

18 Claims, 8 Drawing Sheets

SHEET FEEDING APPARATUS AND IMAGE FORMING SYSTEM

CROSS-REFERENCE TO RELATED APPLICATION

This application is based on Japanese Patent Application No. 2009-280213 filed on Dec. 10, 2009 and No. 2010-88502 filed on Apr. 7, 2010 in Japanese Patent Office, the entire contents of which are hereby incorporated by reference,

BACKGROUND OF INVENTION

1. Field of the Invention

The present invention relates to a sheet feeding apparatus which separates and feeds a sheet one by one from a sheet bundle stacked on a sheet loading table, and an image forming system equipped with the aforesaid sheet feeding apparatus.

2. Description of the Related Art

Heretofore, there has been known an air sheet feeding apparatus which supplies a sheet one by one to an image forming section of an image forming apparatus such as a copier and a printer.

The air sheet feeding apparatus is equipped with an air suction section at the inside of an endless belt, adsorbs a sheet one by one with a perforated belt and the like in which air suction inlets are formed, and conveys the sheet by rotating the belt.

As an adsorption conveyance section of such an air sheet feeding apparatus, there has been known an apparatus in which a conveyance surface which adsorbs a sheet is composed of a plane and an inclined plane (for example, JP-A No. H6-199438). Further, there has been known an apparatus in which projections are protruded between belts to bend a sheet to be adsorbed, and separation air is allowed to be blown (for example, JP-A No. 62-16944).

However, there are many variety kinds of sheets of paper, and there exist a flexible and poor fragile sheet of paper, and a sheet of paper in which sheet forming pulp is cellular and thereby even the second sheet is absorbed through the absorbed top sheet and conveyed. In case of such sheets of paper, even by the sheet feeding apparatus described in the above Patent Documents 1 and 2, the gap between sheets to blow separation air can not be formed, resulting in a double sheet feeding problem.

SUMMARY OF THE INVENTION

In view of the foregoing problems, it is objects of the present invention to provide a sheet feeding apparatus which can securely separate and convey a sheet of paper one by one even if the sheet is flexible and poor fragile, or the pulp which forms the sheet is cellular, and an image forming system equipped with the aforesaid sheet feeding apparatus.

To achieve at least one of the abovementioned objects, a sheet feeding apparatus reflecting one aspect of the present invention includes: a sheet loading table for loading a stack of sheets; and an adsorption conveyance section having: multiple belts which are located above the sheets loaded on the sheet loading table and in which a plurality of through-holes are formed; and an air suction section which is located in an inside of the belts and absorbs air through the through-holes; wherein the adsorption conveyance section sucks air by the air suction section, allows the sheet to be adsorbed to the belt, and conveys it in a conveyance direction; the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller, and an outer surface of the belts mostly protrudes towards the stack of sheets loaded on the sheet loading table at a central part of the third roller in a cross section perpendicular to the conveyance direction containing a shaft of the third roller.

In above sheet feeding apparatus, it is preferable that an outer diameter of the third roller is formed so that it becomes smaller with distance from the central part of the third roller to outside in an axial direction of the third roller.

In above sheet feeding apparatus, it is also preferable that a thickness of each of the belts is formed to be slanted so that each belt is thicker at one end surface and is thinner at the other end surface, and each belt is stretched and supported so that the thicker end surfaces adjoin each other.

In above sheet feeding apparatus, it is also preferable that when a distance between a shaft position of the third roller and a position of a dividing wall of the air suction section provided at downstream side of the air suction section in the conveyance direction is denoted by A, and a difference in height of an outer surface of the belt between a height of the outer surface at shaft position of the third roller and a height of the outer surface at the position of the dividing wall of the air suction section provided at downstream side of the air suction section is denoted by r, a ratio of r to A satisfies the following formula:

$$1/5 \geqq r/A \geqq 1/20.$$

In above sheet feeding apparatus, it is also preferable that a pulley is arranged between the multiple belts at the central part of the third roller, and wherein when a distance between an end surface position at a center part of the third roller of the belt and a position of a dividing wall of the air suction section in an axial direction of the third roller is denoted by B, and a difference in height of the outer surface of the belt between a height of the outer surface of the belt at a position of the pulley side of the belt and a height of the outer surface of the belt at a dividing wall position of the air suction section is denoted by s, a ratio of s to B satisfies the following formula:

$$1/10 \geqq s/B \geqq 1/40.$$

In above sheet feeding apparatus, it is also preferable that a pulley is arranged between the multiple belts at the central part of the third roller, and an outer surface of the pulley projects from an outer surface of the belt.

In above sheet feeding apparatus, it is also preferable that a projecting member, which projects from an outer surface of the belt and is located between the multiple belts, is arranged downstream of the third roller in the conveyance direction.

In above sheet feeding apparatus, it is also preferable that a dividing wall of the air suction section is formed in such a shape that avoids the projecting member.

In above sheet feeding apparatus, it is also preferable that a dividing wall of the air suction section at a first roller side is formed so as to become more depressed with distance from a corner of the dividing wall to a central portion of the dividing wall.

In above sheet feeding apparatus, it is also preferable that the sheet feeding apparatus further comprises a blower unit which blows air in a direction from a downstream of the third roller in the conveyance direction of the sheet of paper to the third roller, and, in the blower unit, multiple ribs and multiple air blower paths between the multiple ribs are formed, and a height of a lowest position of a bottom surface of an air blower path among the multiple air blower paths that opposes the central part of the third roller is lowered than a bottom surface of an air blower path adjoining to the air blower path among the multiple air blower paths.

DETAILED DESCRIPTION FOR THE PREFERRED EMBODIMENTS

The present invention will be described in detail below with reference to embodiments, but the invention is not limited to them.

The present embodiments will be described below with reference to drawings.

[Image Forming Apparatus]

Figure 1:
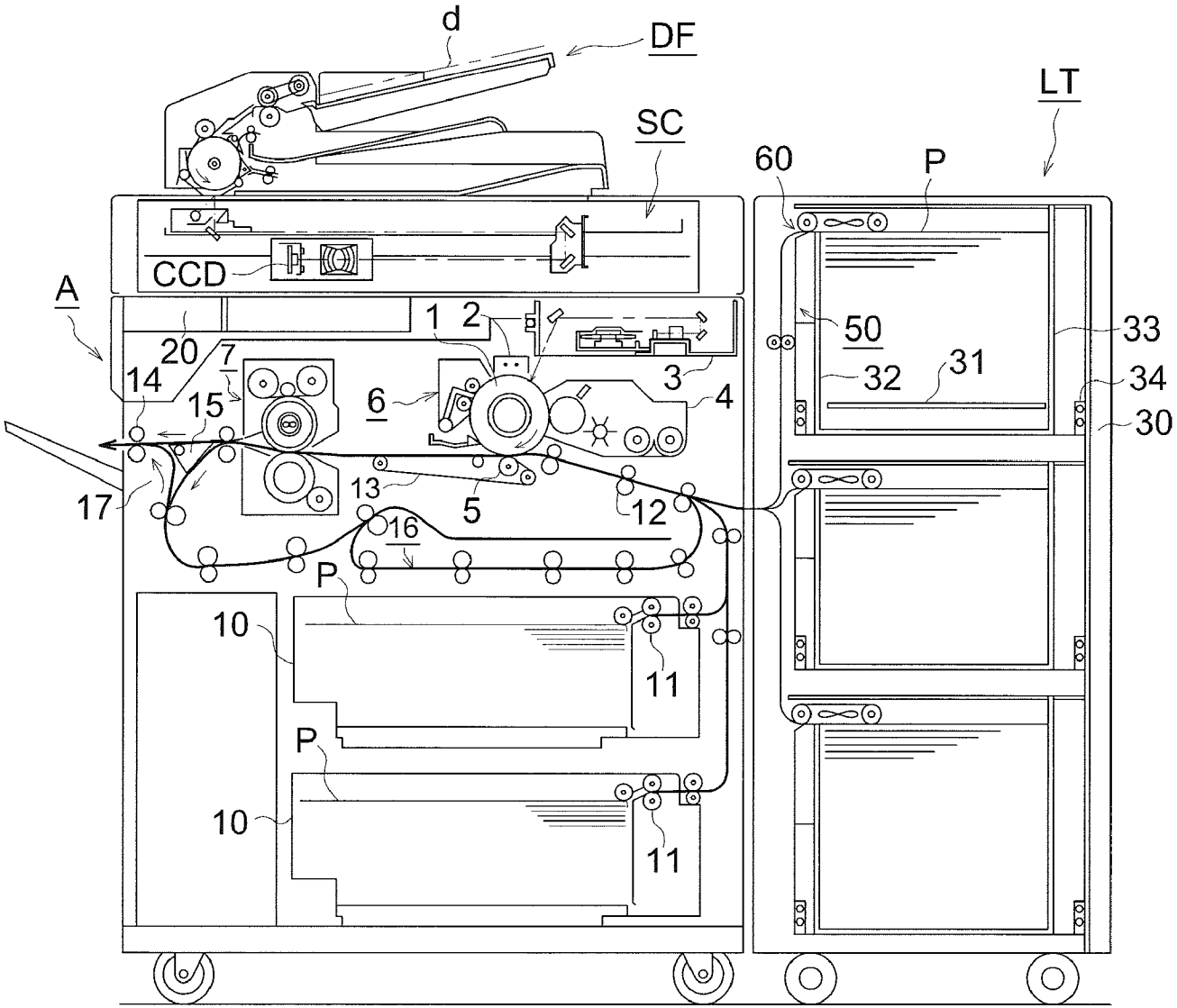
FIG. 1 is an overall configuration diagram of an image forming system composed of an image forming apparatus, an image reading device, an automatic document feeder, and a large-capacity sheet feeder.

FIG. 1 is an overall configuration diagram of an image forming system composed of an image forming apparatus A, an image reading device SC, an automatic document feeder DF, and a large-capacity sheet feeder LT.

The illustrated image forming apparatus A is composed of an image forming section comprising a photoreceptor (an image bearing body) 1, a charger 2, an image exposing device 3, a development device 4, a transfer device 5, a cleaning device 6, and the like, and a fixing device 7 as well as a sheet conveyance system.

The sheet conveyance system is configured by sections such as a sheet feeding cassette 10, a first sheet feeding section 11, a second sheet feeding section 12, a sheet ejection section 14, a conveyance path switching section 15, a circulation sheet refeeding section 16, and a reversal sheet ejection section 17.

A document d placed on a document platen of the automatic document feeder DF is conveyed by a sheet feeding section. Then, an image of one side or both sides of the document is read by an optical system of the image reading device SC, and is then read by an image sensor CCD. An analogue signal, photoelectrically converted by the image sensor CCD, is subjected to an analogue processing, an A/D conversion, a shading compensation, an image compression processing, and the like, at an image processing section 20, after which the image signal is sent to the image exposing device 3.

In the image forming section, processing such as charging, exposing, developing, transferring, separation, and cleaning is carried out.

In the image forming section, the photoreceptor 1 is charged by the charger 2 (in the present embodiment, negatively charged), an electrostatic latent image is formed by a laser beam irradiation from the image exposing device 3, and the electrostatic latent image is visualized by the development device 4 into a toner image (in the present embodiment, the toner is negatively charged). Subsequently, a sheet P accommodated in the sheet feeding cassette 10 is conveyed from the first sheet feeding section 11. The residual toner on the photoreceptor 1 after transfer processing is removed by the cleaning device 6.

The sheet P is synchronized with the toner image at the second sheet feeding section 12 composed of registration rollers, after which the sheet P is conveyed. Then, after the toner image is transferred to the sheet P by the transfer device 5, the toner image is fixed onto the sheet P by the fixing device 7. The sheet P after being fixed is ejected outside the apparatus by the sheet ejection section 14.

In case of two-sided copying, the sheet P, in which an image was formed on the first surface, is sent to the circulation sheet refeeding section 16 and then reversed. After an image is again fanned on the second surface at the image forming section, the sheet P is ejected outside the apparatus by the sheet ejection section 14. In case of reversal sheet ejection, the sheet P, branched off a regular ejection path, is switchbacked at the reversal sheet ejection section 17, and then the front and back sides of the sheet P are reversed, after which the sheet P is ejected outside the apparatus by the sheet ejection section 14.

[Sheet Feeding Apparatus]

The large-capacity sheet feeder LT, connected to the image forming apparatus A, is equipped with a plurality of sheet feeding apparatus bodies 30 in the inside thereof, accommodates a large amount of sheets P, and feeds the sheets P one by one to the image forming apparatus A.

The sheet feeding apparatus body 30 is equipped with a sheet loading table 31, a sheet leading edge control member 32, a sheet trailing edge control member 33, and a guide rail 34. In this example, the sheet loading table 31 is triple-decker racks, and each of sheet loading tables 31 is constituted so that it is drawable from the large-capacity sheet feeder LT by the guide rail 34. For example, the large-capacity sheet feeder LT can accommodate 1,300 sheets in the first tray, 1,850 sheets in each of the second and the third trays, and as a total, it can accommodates about 5,000 sheets.

Figure 2:
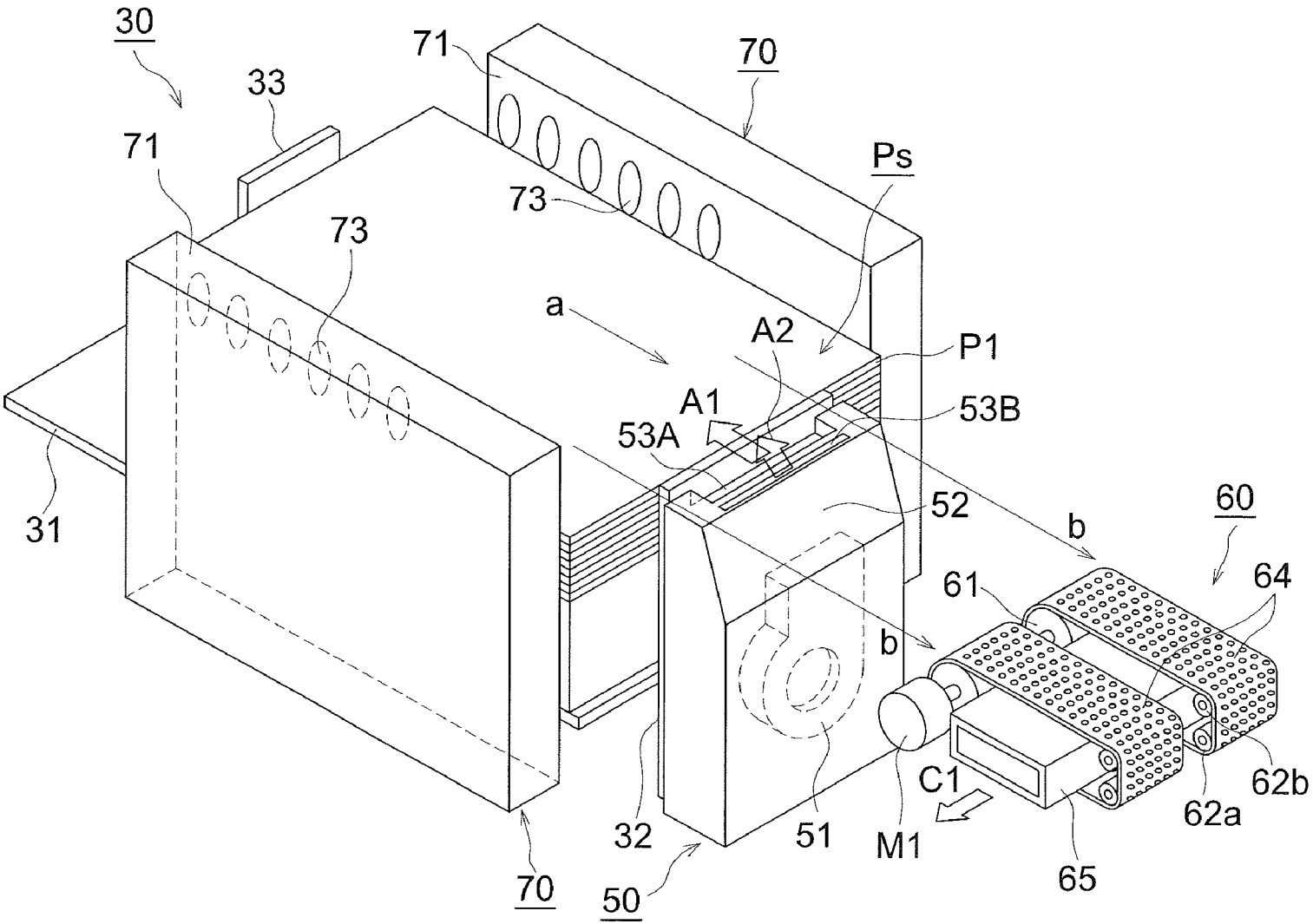
FIG. 2 is a perspective view showing the principal parts of a sheet feeding apparatus body.
Figure 3:
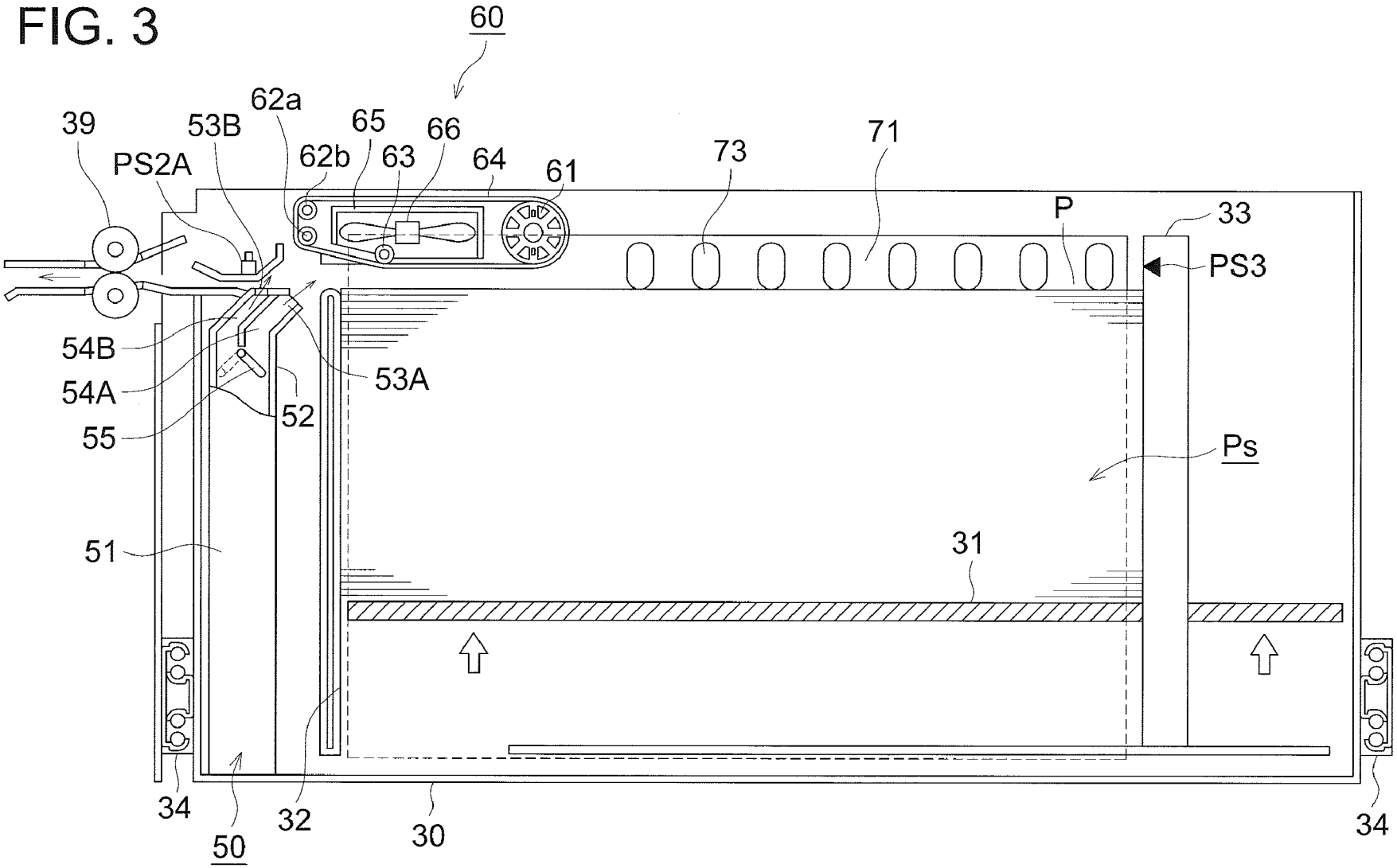
FIG. 3 is a schematic cross section of a sheet feeding apparatus body.

FIG. 2 is a perspective view showing the principal parts of the sheet feeding apparatus body 30, and FIG. 3 is a schematic cross section of the sheet feeding apparatus body 30. In FIG. 2, an adsorption conveyance section 60 is shown in a temporary position, which is horizontally shifted by a length indicated by the arrow b toward downstream in the sheet conveyance direction from a position where it is usually arranged in the sheet feeding apparatus body 30.

As shown in FIG. 2, a sheet bundle Ps and a sheet P1 placed on top thereof are stacked on the sheet loading table 31 and are housed together with the sheet loading table 31 in such a way that they can move up and down by a non-illustrated mechanism.

A pair of sheet side edge control units 70 is a unit which controls the sheet bundle Ps in the width direction perpendicular to the sheet conveyance direction, and has sheet side edge control members 71 in the inside of the units, which members are adjacent to the side edges of the sheet bundle Ps. The sheet side edge control units 70 are freely changeable in a relative distance in the sheet width direction, and thereby, corresponding to a sheet size, a position in the width direction of the sheet bundle Ps is controlled.

The sheet side edge control unit 70 is sufficiently long in the sheet conveyance direction, and forms a box-shaped structure exhibiting rigid strength, which, even in the top part of the sheet bundle Ps, enables maintaining a gap between the sheet side edge control members 71 and the side edge of the sheet of less than a prescribed size even for a variety of sheet sizes.

The sheet leading edge control member 32 controls the leading edge of the sheet bundle Ps on the sheet loading table 31, and is fixingly arranged on the sheet feeding apparatus body 30.

The sheet trailing edge control member 33 is freely movable in the length direction of the sheet P, controls a position of the trailing edge in the conveyance direction of the sheet P, and is supported position-changeably in the sheet conveyance direction by the sheet feeding apparatus body 30. The sheet side edge control members 71 and the sheet trailing edge control member 33 are provided with height and a shape so that a sheet of paper floated by wind blowing to be described is continually controlled.

As shown in FIG. 3, at the sheet trailing edge control member 33, there is arranged a height sensor PS3 to detect the uppermost height of the sheet bundle stacked on the sheet loading table 31.

The uppermost position of the sheet bundle Ps stacked on the sheet loading table 31 is kept, by a control section to be described, to an optimal height where it can receive air blowing based on a signal of the height sensor PS3. Namely, based on the detection result of the height sensor PS3, shown in FIG. 3, a non-illustrated elevating motor is driven to raise a bottom plate 34 of the sheet loading table 31, whereby a control is carried out so that the uppermost surface of sheets is always kept to the prescribed height.

At the exit side of the large-capacity sheet feeder LT, there is arranged a conveyance roller pair 39 comprising two rollers, driving and driven rollers, which conveys the sheet P, which was conveyed by the adsorption conveyance section 60, to the image forming apparatus A.

In addition, at the downstream side of the sheet loading table 31 in the sheet conveyance direction, a blower unit 50 is arranged.

<Adsorption Conveyance Section>

As shown in FIG. 3, the adsorption conveyance section 60 is positioned above the sheet bundle Ps stacked on the sheet loading table 31, and arranged downstream in the sheet conveyance direction.

Figure 4B:
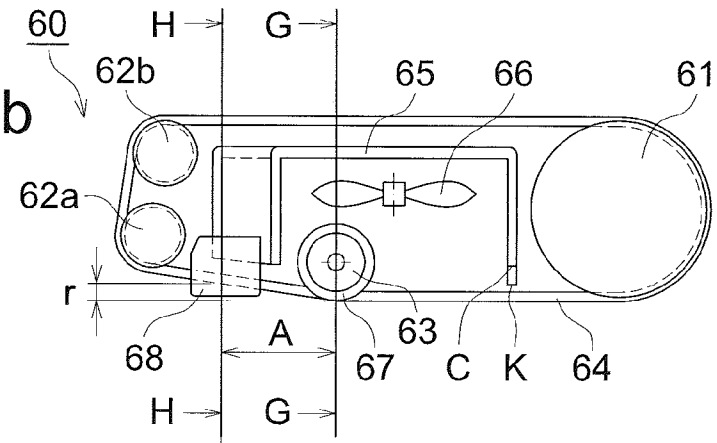
FIGS. 4*a*, 4*b* and 4*c* are figures showing an example of an adsorption conveyance section relating to the present embodiment.
Figure 4A:
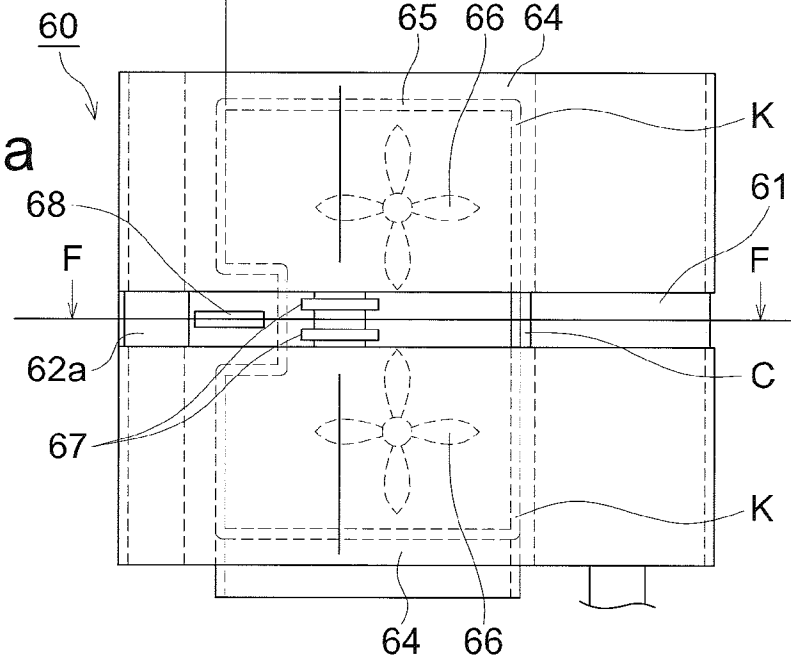
Figure 4C:
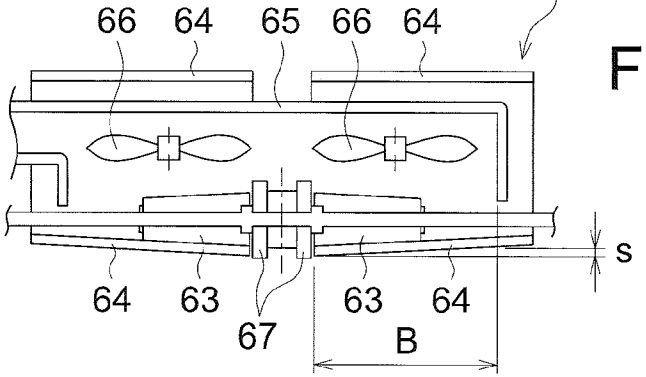

FIGS. 4*a* through 4*c* are figures showing an example of the adsorption conveyance section relating to the present embodiment. FIG. 4*a* is a figure viewing the adsorption conveyance section 60 from the sheet P side, FIG. 4*b* is a cross section cut by the line F-F in FIG. 4*a*, and FIG. 4*c* is a cross section cut by the line G-G in FIG. 4*b*.

As shown in FIG. 4*b*, the adsorption conveyance section 60 is stretched and supported by the first roller 61, which is arranged at the inside of one end of an endless belt 64 in which a plurality of small sized through holes are formed (hereinafter referred to as the adsorption belt), and driving force is supplied to the adsorption belt 64 by a motor MI (refer to FIG. 2); the second rollers 62*a* and 62*b*, which are arranged at the inside of the other end and rotated, (in this example, two small sized rollers are used, but one roller may works well); and the third roller 63, which is rotated at the inside of the sheet P between the first roller 61 and the second roller 62*a*.

The two adsorption belts 64 are stretched and supported in such a manner that they are almost parallel to the sheet P at between the first roller 61 and the third roller 63 at adjoining end surface side as shown in FIG. 4*b*, and are slanted with respect to the sheet P at between the third roller 63 and the second roller 62*a*.

At the inside of the adsorption belt 64, there are arranged a air air suction duct 65, an air suction section which sucks air through through-holes, and a suction fan 66 inside the air air suction duct 65. It is configured so that air sucked by the suction fan 66 is discharged laterally through the air air suction duct 65.

As shown in FIG. 4*c*, the outer diameter of the third roller is formed so that it becomes smaller with distance from a pulley 67.

Namely, in the cross section (FIG. 4*c*) containing the rotation axis of the third roller, which section is perpendicular to the conveyance direction, the outer surface of the adsorption belt 64 having an almost uniform thickness is stretched and supported with the central part being projected most prominently. When viewed as the adsorption conveyance section 60, at the position of the third roller 63, the outer surface of the adsorption belt 64 having an almost uniform thickness is projected at an almost central part of the drawing and slanted as shown in the figure.

Further, as shown in FIGS. 4*a* and 4*b*, between the third roller 63 and the second roller 62*a*, there is arranged a projecting member 68 projecting from the outer surface of the adsorption belt 64, which is stretched and supported with being slanted with respect to the sheet P. The dividing wall of the air suction duct 65, an air suction section, is formed in such a shape that it avoids the projecting member 68.

By stretching and supporting the adsorption belt 64 in such a manner, the uppermost sheet of paper adsorbed by the adsorption belt 64 and the second sheet of paper can be surely separated.

Figure 5A:
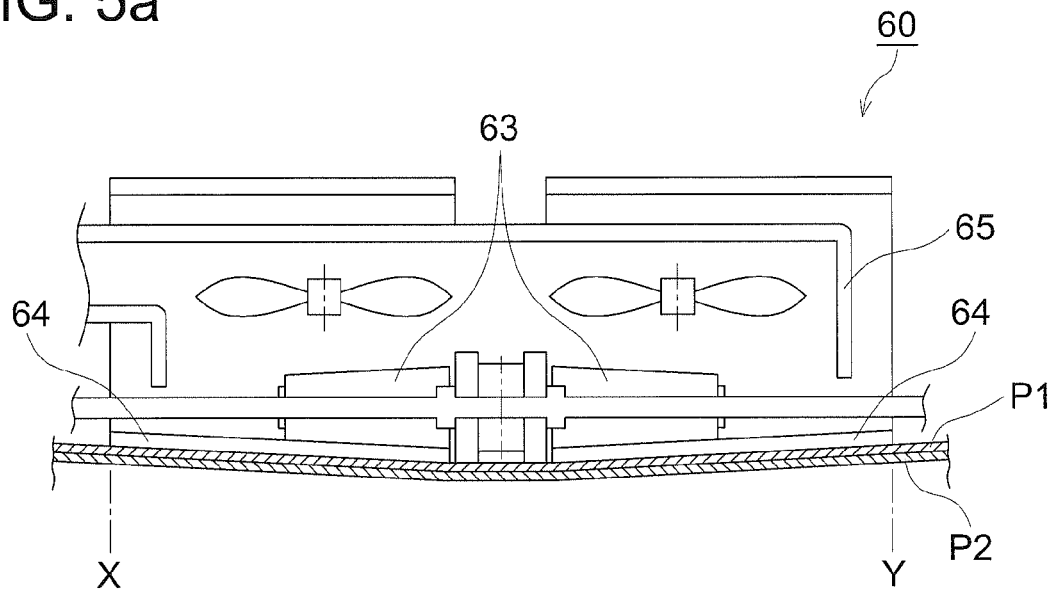
FIGS. 5*a* and 5*b* are schematic cross section showing states of the uppermost sheet of paper adsorbed by an adsorption belt and a second sheet of paper.
Figure 5B:
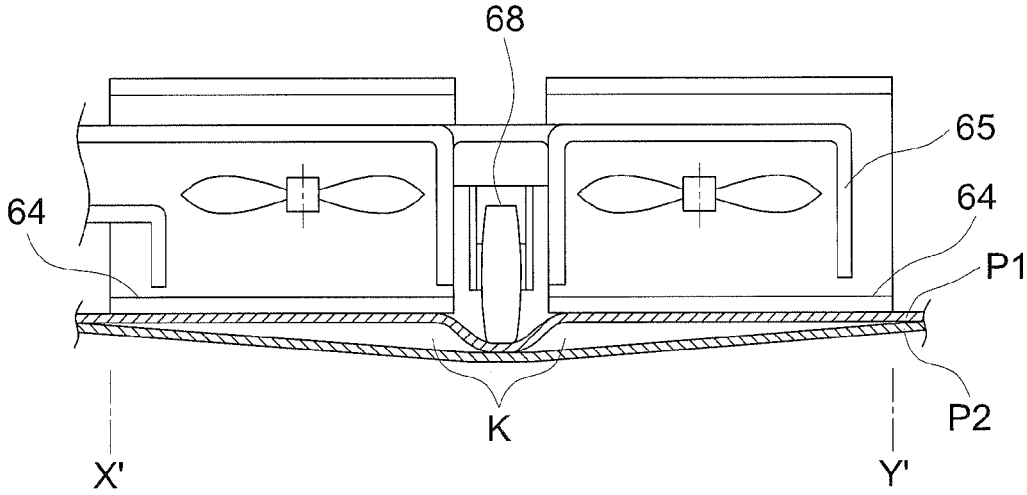

FIG. 5 is a schematic cross section showing a state of the uppermost sheet of paper adsorbed by the adsorption belt 64 and the second sheet of paper. FIG. 5*a* shows a cross section cut by the line G-G in FIG. 4*b* like FIG. 4*c*, and FIG. 5*b* is a cross section cut by the line H-H in FIG. 4*b*.

As shown in FIG. 5*a*, the uppermost sheet P1 is adsorbed by air sucked by the suction fan 66 with curvature along a slant in the direction perpendicular to the conveyance direction (refer to FIG. 4*c*) and a slant in the conveyance direction (refer to FIG. 4*b*) of the adsorption belt 64. Therefore, the length of the uppermost sheet P1 and the second sheet P2, which are adsorbed from the point X to the point Y in the above figure, is slightly longer than the straight-line distance from the point X to the point Y (the difference in these two lengths is represented by L).

On the other hand, in the H-H cross section shown in FIG. 5*b*, the slant of the outer surface of the belt 64 in the direction perpendicular to the conveyance direction is gentler than that in the G-G cross section and the outer surface of the belt 64 is nearly a straight line. In this H-H cross section, due to the above-mentioned L, the sheet P1, adsorbed to the belt surface with being nearly a straight line, becomes a distorted state so that the sheet P1 sticks to the projecting member 68 as shown in FIG. 5*b*. In contrast, since the sucking force from the belt 64 to the second sheet P2 is not so strong compared to that to the sheet P1, the second sheet P2 does not have a shape of sticking to the projecting member 68, and floats in a shape nearly at the G-G cross section as shown in figure.

As described above, a large shape difference of cross section between the uppermost sheet P1 and the second sheet P2 is produced, and thereby a space K or a gap is formed. By performing the air blast to the space by the blower unit 50 (refer to FIG. 3), it becomes possible to surely separate the uppermost sheet P1 from the second sheet P2.

As shown in FIGS. 4*a* and 4*c*, the two adsorption belts 64 are stretched and supported at the central part of the adsorption conveyance section 60 with having a gap, and, in this gap, the freely rotatable wheel-like pulleys 67, in which their shaft is coaxial with the third roller 63, are arranged. The circumferential surface of the pulley 67 is preferably projected from the adjacent adsorption belt 64.

Figure 6:
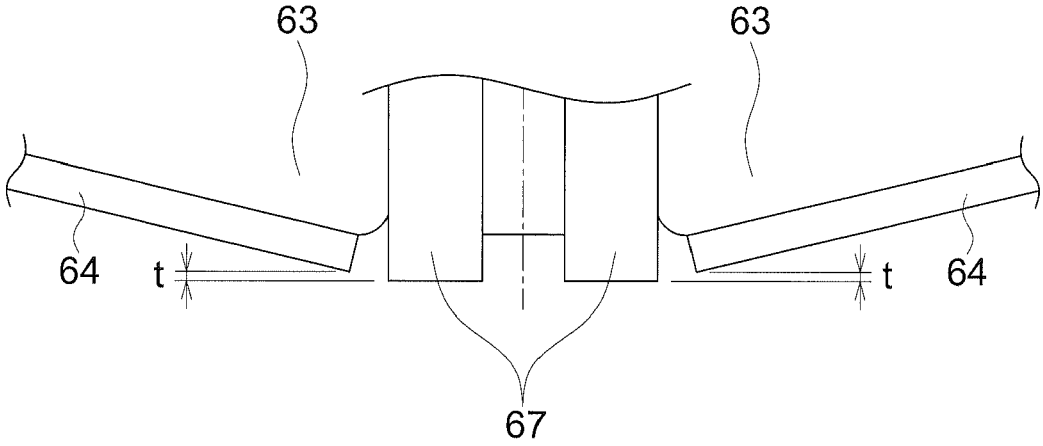
FIG. 6 is a figure showing a height relationship between a pulley and an outer surface of an adsorption belt at a central part of the third roller.

FIG. 6 is a figure showing a height relationship between the pulley and the outer surface of the adsorption belt at a central part of the third roller.

As shown in FIG. 6, the circumferential surface of the pulley 67 is preferably projected from the adjacent adsorption belt 64. The difference t in height of the circumferential surface of the pulley 67 from the outer surface of the adjacent adsorption belt 64 is preferably 0.1 to 0.5 mm.

Figure 7:
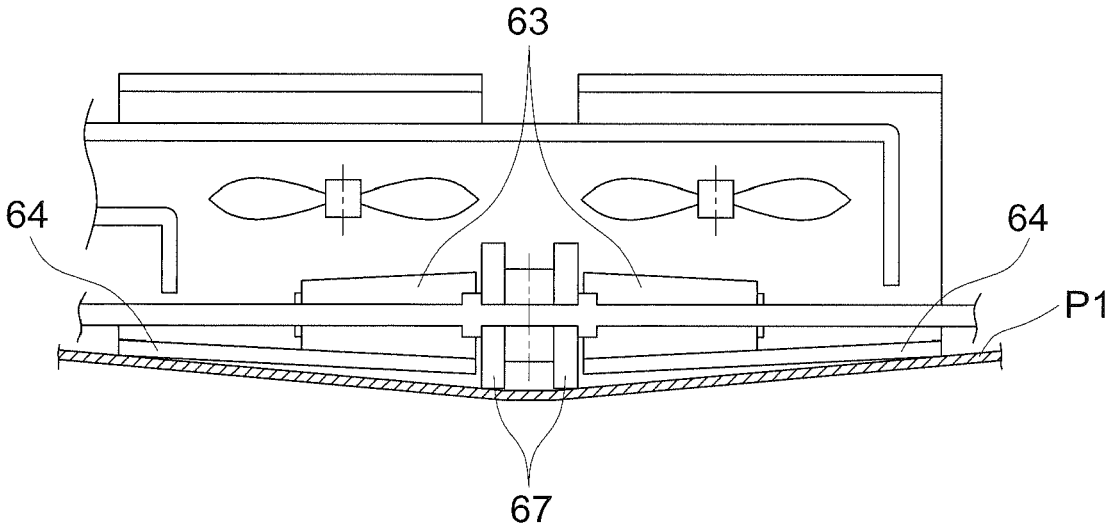
FIG. 7 is a schematic diagram showing states of the uppermost sheet of paper adsorbed to an adsorption belt and a second sheet of paper when a lateral surface of a pulley is projected from an outer surface of an adjacent adsorption belt.

FIG. 7 is a schematic diagram showing a state of the uppermost sheet P1 adsorbed to the adsorption belt 64 when the circumferential surface of the pulley 67 is projected from the outer surface of the adjacent adsorption belt. Incidentally, FIG. 5 shows a cross section cut by the line G-Gin FIG. 4*b* like FIG. 4*c*.

As shown in FIG. 7, it is preferable that the circumferential surface of the pulley 67 is allowed to be projected from the outer surface of the adjacent adsorption belt 64. Such a configuration can reduce friction between the adsorption belt 64 and the sheet P1 when, after completion of sending out the sheet P1, the drive of the adsorption belt 64 is stopped, and then the sheet P1 is conveyed by the conveyance roller 39, and thereby scratch and the like, which may be generated on the sheet surface, can be prevented.

The side wall at the first roller 61 side of the air suction duct 65 is formed in such a manner that a gap between the central part C and the adsorption belt 64 is made different from a gap between the corner K and the adsorption belt 64, and a distance between the central part C and the adsorption belt 64 becomes larger than a distance between the corner K and the adsorption belt 64. Namely, the dividing wall is formed so that it becomes more depressed with distance from the corner K to the central part C. By forming the dividing wall in such a manner, when the sheet is sucked by the adsorption belt 64 and thereby the adsorption belt 64 and the sheet are bent, it becomes possible to surely separate the uppermost sheet P1 from the second sheet P2, It is preferable that the outer surface of the adsorption belt 64 is stretched and supported in a manner described below.

As shown in FIG. 4*a*, when a distance between a shaft position of the third roller 63 and a position of a dividing wall of the air air suction duct 65 provided at downstream side of the air air suction duct 65 in the conveyance direction is denoted by A, and a difference in height of the outer surface position of the adsorption belt 64 between a height of the outer surface at shaft position of the third roller 63 and a height of the outer surface at the position of the dividing wall of the air air suction duct 65 provided at downstream side of the air air suction duct 65 is denoted by r, the outer surface of the adsorption belt 64 is preferably stretched and supported so that a ratio of r to A satisfies the following formula:

$$1/5 \geqq r/A \geqq 1/20 \qquad \text{Formula (1):}$$

With this, it becomes possible to surely separate the uppermost sheet P1 adsorbed by the adsorption belt from the second sheet P2.

As shown in FIG. 4*c*, when a distance between an end surface position at the pulley 67 side of the adsorption belt 64 and a dividing wall position of the air air suction duct 65 in the shaft direction of the third roller 63 is denoted by B, and a difference in height of the outer surface position of the adsorption belt 64 in the direction perpendicular to the sheet surface between a height of the outer surface position of the pulley 67 side of the adsorption belt 64 and a dividing wall position of the air air suction duct 65 is denoted by s, the outer surface of the adsorption belt 64 is preferably stretched and supported so that a ratio of s to B satisfies the following formula:

$$1/10 \geqq s/B \geqq 1/40 \qquad \text{Formula (2):}$$

With this, it becomes possible to surely separate the uppermost sheet P1 sucked by the adsorption belt from the second sheet P2.

<Deformation Example of Adsorption Conveyance Section>

Figure 8:
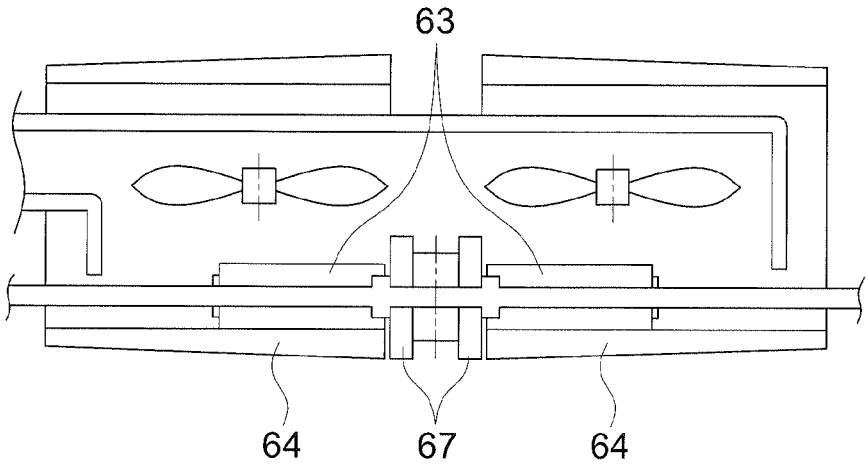
FIG. 8 is a figure showing a deformation example of an adsorption conveyance section relating to the present embodiment.

In the above embodiment, there was described an embodiment in which the slant in the direction perpendicular to the conveyance direction of the adsorption belt 64 (refer to FIG. 4*c*) was formed by varying a diameter of the third roller 63 with the thickness of the adsorption belt 64 being uniform, but the embodiment is not limited to it. For example, as shown in FIG. 8, with the diameter of the third roller 63 being fixed, the adsorption belt 64 is formed so that it is made thicker at the pulley 67 side and it becomes thinner with distance from the pulley 67, and then the thus formed adsorption belt 64 may be stretched and supported so that the thicker end surfaces are adjacent with each other.

<Blower Unit>

The blower unit 50, a sheet separation apparatus arranged downstream of the sheet loading table 31 in the sheet sending direction, will be described.

As shown in FIGS. 2 and 3, the blower unit 50 is composed of an electric-powered fan 51 and a blower guide 52, which is connected to the electric-powered fan 51. The blower unit 50 sends air from a blower path 53A of the blower guide 52 in the direction of an end and upper part of a sheet bundle stacked on the sheet loading table 31 (in the arrow Al direction in FIG. 2).

The air blow from the first blower path 53A is intended to sort and float the uppermost sheet P of the sheet bundle Ps, and is directed toward the upper part of the front end of the sheet bundle Ps. Above the blower guide 52, the second blower path 53B is arranged downstream of the first blow path 53A, and the second blower path 538 has an opening toward upper part than the first blower path 53A.

The air blow from the second blower path 53B is intended to separate the sheets of paper into one sheet, which sheets of paper are to be adsorbed to the adsorption conveyance section 60 and conveyed.

The blower guide 52 is formed, as shown in FIG. 3, into a duct structure, in which the first blow path 53A is connected to the electric-powered fan 51, or the second blower path 53B is connected to the electric-powered fan 51. The duct is branched off into the first blow path 53A and the second blower path 53B. The duct has a shutter 55 at the branching point, and the shutter 55 makes an air volume flowing in the first blow path 53A and the second blower path 53B switchable.

Namely, the blower unit 50 of the present example is designed to be used in both ways; for sorting and floating the uppermost sheet P of the sheet bundle Ps, and for separating the sheets of paper into one sheet, which will be adsorbed to the adsorption conveyance section 60 and conveyed. However, it is not limited to it, and any blower unit may be used as long as it may have at least a function for sending air (being equivalent to the second blower path) to separate the sheets of paper into one sheet, which will be adsorbed to the adsorption conveyance section 60 and conveyed.

Subsequently, shapes of a sheet of paper to be adsorbed to the above-described adsorption conveyance section 60 and conveyed, and of the blower unit 50 will be detailed.

Figure 9:
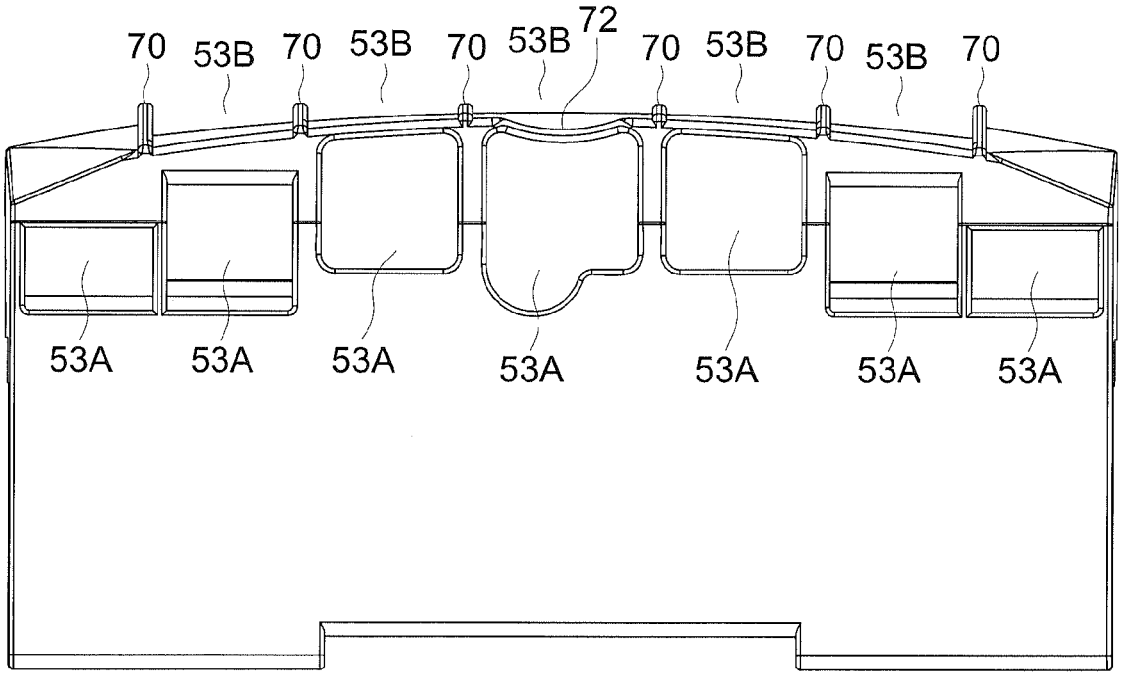
FIG. 9 is a front view of a blower unit viewed from a sheet bundle side.

FIG. 9 is a front view of the blower unit 50 viewed from the sheet bundle.

As shown in FIG. 9, in the blower unit 50, there are formed, above the first blow path 53A, a plurality of ribs 70 and a plurality of the second blower paths 53B between the aforesaid ribs 70, and the blower unit 50 is formed so that the height of the lower part of a bottom surface 72 of the second blower path 53B corresponding to the central part of a sheet of paper to be conveyed is lower than the bottom surface of the adjacent second blower paths 53B.

In FIG. 9, an example is shown in which the bottom surface 72 of the second blower path 53B corresponding to the central part of a sheet of paper to be conveyed (corresponding to the central part of the third roller) is formed in a shape being scraped off to be a circular arc. In the present example, the position of the bottom surface 72 where the bottom surface contacts the rib 70 is formed to be almost equal in height to the bottom surface of the adjacent second blower path, and the central area of the circular arc of the bottom surface 72 is formed to be lower than the bottom surface of the adjacent second blower path 53B. The position of the bottom surface 72 where the bottom surface contacts the rib 70 may be formed to be higher or lower than the bottom surface of the adjacent second blower path 53B. Namely, the lowest position of the bottom surface of the second blower path 53B corresponding to the central part of a sheet of paper to be conveyed (corresponding to the central part of the third roller) is formed to be lower than the bottom surface of the adjacent second blower path 53B.

Further, the blower unit 50 is formed so that the difference in height between the lowest position of the bottom surface 72 of the second blower path 53B corresponding to the central part of a sheet of paper to be conveyed and the height of the rib 70 partitioning the bottom surface 72 is larger than the amount of deformation of the central part of the sheet P1 to be adsorbed to the adsorption belt 64 and conveyed.

The shape of the bottom surface 72 corresponding to the central part of a sheet of paper to be conveyed is not limited to the above, but may be other shape such as a V-shape or a U-shape. Also in this case, at least the lowest part of the V-shape or the U-shape may be formed to be lower than the bottom surface of the adjacent second blower path 53B. Further, the shape of the bottom surface 72 may be a flat surface, and in case of the flat surface, at least the height of the bottom surface 72 may be formed to be lower than the bottom surface of the adjacent second blower path 53B.

Hereinafter, briefly described will be an effect by lowering the lowest position of the bottom surface 72 of the second blower path 53B corresponding to the central part of a sheet of paper to be conveyed than the bottom surface of the adjacent second blower path 53B.

Figure 10:
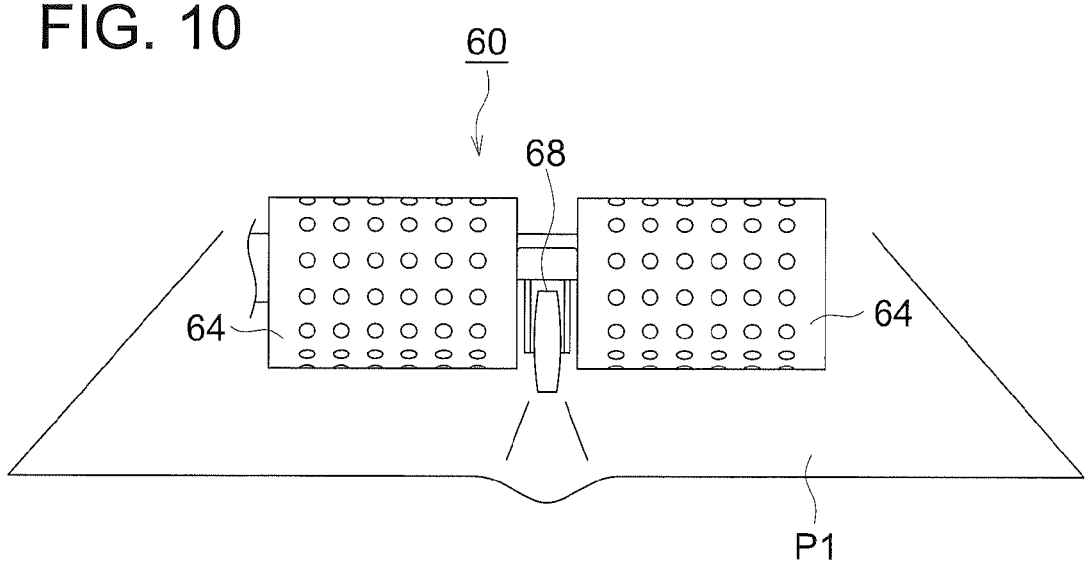
FIG. 10 is a figure showing a schematic shape, viewed from a blower unit side, of a sheet of paper to be adsorbed to an adsorption conveyance section and conveyed.
Figure 11:
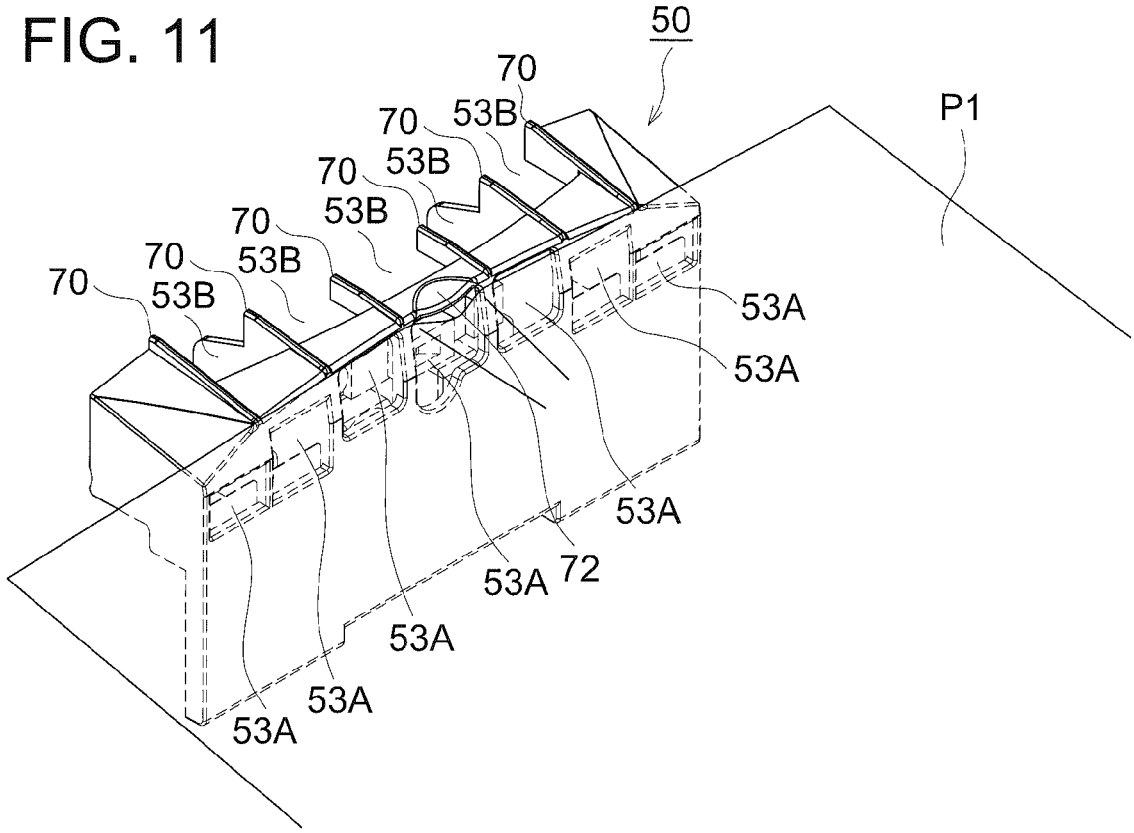
FIG. 11 is a perspective view showing a shape of a blower unit.

FIG. 10 is a figure showing a schematic shape, viewed from the blower unit 50 side, of the sheet P1 to be adsorbed to the adsorption conveyance section 60 and conveyed. FIG. 11 is a perspective view showing a shape of the blower unit 50.

As shown in FIG. 10, the sheet P1 adsorbed to the adsorption belt 64 is conveyed in a distorted state like a downward convex as if the central part sticks to the projecting member 68. The sheet P1 to be conveyed with the central part being distorted is, as shown in FIG. 11, conveyed on the ribs 70, which were formed in the blower unit 50. By lowering the bottom surface 72 of the second blower path 53B corresponding to the central part of this sheet of paper to be conveyed than the bottom surface of the adjacent second blower path 53B, appropriate blowing direction and air volume to separate the sheets into one sheet, which will be adsorbed to the adsorption conveyance section 60 and conveyed can be secured. Further, the portion distorted like a downward convex of the central part of the sheet P1 can avoid contacting the front of the blower unit 50, and thereby a conveyance failure due to paper jamming can be dissolved. With this, it becomes possible to securely convey a sheet of paper.

EXAMPLES

The above Formulae (1) and (2) will be described based on the examples.

The following experiments were carried out to obtain optimum slant values of the adsorption belt 64, at a position of the third roller 63, in the direction perpendicular to the conveyance direction (refer to FIG. 4*c*) and in the conveyance direction (refer to FIG. 4*b*).

The conditions of the experiments using the adsorption conveyance section 60, shown in FIG. 4, were as follows:

Distance between shafts of the first roller 61 and the third roller 63 (being a distance parallel to the sheet of paper): 80 mm, Distance between shafts of the second roller 62*a* and the third roller 63 (being a distance parallel to the sheet of paper): 50 mm, Width of the adsorption belt: 40 mm, Gap between the two adsorption belts: 12 mm, Hole of the adsorption belt: $\phi$=3 mm, Distance between holes of the adsorption belt: 6 mm pitch in height and width Sucking force of the suction fan (negative pressure): 300 MPa, and Opening shape of the sheet side of the suction duct: □76 mm (except for avoiding portion of the projecting member).

Experiment 1

Sheet feed experiments were carried out with s and B, shown in FIG. 4*c*, being fixed at 1 mm and 40 mm respectively (s/B=1/40), and r and A, shown in FIG. 4*b*, being varied as follows:

Comparative example 1: r/A=1/40 (r=0.5 mm, and A=20 mm)

Example 1: r/A=1/20 (r=1 mm, and A=20 mm)

Example 2: r/A=1/10 (r=2 mm, and A=20 mm)

Example 3: r/A=1/5 (r=4 mm, and A=20 mm)

Comparative example 2: r/A=1/4 (r=5 mm, and A=20 mm)

Results of Experiment 1 are shown in Table 1 below.

The evaluation criteria was that, after feeding of 1,000 of sheets of paper, in case where at least one double-feed or no-feed occurred, the sample was evaluated as N, and in case where no double-feed or no-feed occurred, the sample was evaluated as G.

TABLE 1

| | r (mm) | A (mm) | r/A | Result | Evaluation |
|---|---|---|---|---|---|
| Comparative Example 1 | 0.5 | 20 | 1/40 | Generation of Double-Feed | N |
| Example 1 | 1 | 20 | 1/20 | OK | G |
| Example 2 | 2 | 20 | 1/10 | OK | G |
| Example 3 | 4 | 20 | 1/5 | OK | G |
| Comparative Example 2 | 5 | 20 | 1/4 | Generation of No-Feed | N |

Note:
s = 1 mm, and B = 40 mm (s/B = 1/40) for all samples

As shown in Table 1, the double-feed occurred in Comparative Example 1, in which r/A value was lower than that of Formula (1), and the no-feed occurred in Comparative Example 2, in which r/A value was higher than that of Formula (1). On the other hand, in Examples 1 to 3, in which r/A values satisfy Formula (1), sheet by sheet feeding was certainly carried out.

Namely, by satisfying Formula (1), the sheet feeding apparatus, which can securely separate and convey a sheet of paper one by one, can be realized.

Experiment 2

Sheet feed experiments were carried out with r and A, shown in FIG. 4*b*, being fixed at 1 mm and 20 mm respectively (r/A=1/20), and s and B, shown in FIG. 4*c*, being varied as follows:

Comparative example 3: s/B=1/80 (s=0.5 mm, and B=40 mm)

Example 4: s/B=1/40 (s=1 mm, and B=40 mm)

Example 5: s/B=1/20 (s=2 mm, and B=40 mm)

Example 6: s/B=1/10 (s=4 mm, and B=40 mm)

Comparative example 4: s/B=1/6.7 (s=6 mm, and B=40 mm)

Results of Experiment 2 are shown in Table 2 below.

The evaluation criteria are the same as those of Experiment 1.

TABLE 2

| | s (mm) | B (mm) | s/B | Result, | Evaluation |
|---|---|---|---|---|---|
| Comparative example 3 | 0.5 | 40 | 1/80 | Generation of Double-Feed | N |
| Example 4 | 1 | 40 | 1/40 | OK | G |
| Example 5 | 2 | 40 | 1/20 | OK | G |
| Example 6 | 4 | 40 | 1/10 | OK | G |
| Comparative example 4 | 6 | 40 | 1/6.7 | Generation of No-Feed | N |

Note:
r = 1 mm, and A = 20 mm (r/A = 1/20) for all samples

As shown in Table 2, the double-feed occurred in Comparative Example 3, in which s/B value was lower than that of Formula (2), and the no-feed occurred in Comparative Example 4, in which s/B value was higher than that of Formula (2). On the other hand, in Examples 4 to 6, in which s/B values satisfy Formula (2), sheet by sheet feeding was certainly carried out.

Namely, by satisfying Formula (2), the sheet feeding apparatus, which can securely separate and convey a sheet of paper one by one can be realized.

According to the present embodiment, it is possible to provide a sheet feeding apparatus which can securely separate and convey a sheet of paper one by one even if the sheet is flexible and poor fragile, or the pulp which forms the sheet is cellular, and an image forming system equipped with the aforesaid sheet feeding apparatus.

What is claimed is:

1. A sheet feeding apparatus comprising:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller;

wherein an outer diameter of the third roller is formed so that it becomes smaller with distance from the central part of the third roller to outside in an axial direction of the third roller.

2. The sheet feeding apparatus described in claim 1, wherein when a distance between a shaft position of the third roller and a position of a dividing wall of the air suction section provided at downstream side of the air suction section in the conveyance direction is denoted by A, and a difference in height of an outer surface of the belt between a height of the outer surface at shaft position of the third roller and a height of the outer surface at the position of the dividing wall of the air suction section provided at downstream side of the air suction section is denoted by r, a ratio of r to A satisfies the following formula:

$$1/5 \geqq r/A \geqq 1/20.$$

3. A sheet feeding apparatus comprising:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller;

wherein a thickness of each of the belts is formed to be slanted so that each belt is thicker at one end surface and is thinner at the other end surface, and each belt is stretched and supported so that the thicker end surfaces adjoin each other.

4. A sheet feeding apparatus comprising:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller;

wherein a pulley is arranged between the multiple belts at the central part of the third roller, and wherein when a distance between an end surface position at a center part of the third roller of the belt and a position of a dividing wall of the air suction section in an axial direction of the third roller is denoted by B, and a difference in height of the outer surface of the belt between a height of the outer surface of the belt at a position of the pulley side of the belt and a height of the outer surface of the belt at a dividing wall position of the air suction section is denoted by s, a ratio of s to B satisfies the following formula:

$$1/10 \geqq s/B \geqq 1/40.$$

5. A sheet feeding apparatus comprising:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller;

wherein a pulley is arranged between the multiple belts at the central part of the third roller, and an outer surface of the pulley projects from an outer surface of the belt.

6. A sheet feeding apparatus comprising:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller;

wherein a projecting member, which projects from an outer surface of the belt and is located between the multiple belts, is arranged downstream of the third roller in the conveyance direction.

7. The sheet feeding apparatus described in the claim 6, wherein a dividing wall of the air suction section is formed in such a shape that avoids the projecting member.

8. A sheet feeding apparatus comprising:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller;

wherein a dividing wall of the air suction section at a first roller side is formed so as to become more depressed with distance from a corner of the dividing wall to a central portion of the dividing wall.

9. A sheet feeding apparatus comprising:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller;

wherein the sheet feeding apparatus further comprises a blower unit which blows air in a direction from a downstream of the third roller in the conveyance direction of the sheet of paper to the third roller, and, in the blower unit, multiple ribs and multiple air blower paths between the multiple ribs are formed, and a height of a lowest position of a bottom surface of an air blower path among the multiple air blower paths that opposes the central part of the third roller is lowered than a bottom surface of an air blower path adjoining to the air blower path among the multiple air blower paths.

10. An image forming system comprising:

a sheet feeding apparatus including:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller; and an image forming apparatus which forms an image on a sheet fed by the sheet feeding apparatus;

wherein an outer diameter of the third roller is formed so that it becomes smaller with distance from the central part of the third roller to outside in an axial direction of the third roller.

11. The sheet feeding apparatus described in claim 10, wherein when a distance between a shaft position of the third roller and a position of a dividing wall of the air suction section provided at downstream side of the air suction section in the conveyance direction is denoted by A, and a difference in height of an outer surface of the belt between a height of the outer surface at shaft position of the third roller and a height of the outer surface at the position of the dividing wall of the air suction section provided at downstream side of the air suction section is denoted by r, a ratio of r to A satisfies the following formula:

$$1/5 \geqq r/A \geqq 1/20.$$

12. An image forming system comprising:

a sheet feeding apparatus including:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller; and an image forming apparatus which forms an image on a sheet fed by the sheet feeding apparatus;

wherein a thickness of each of the belts is formed to be slanted so that each belt is thicker at one end surface and is thinner at the other end surface, and each belt is stretched and supported so that the thicker end surfaces adjoin each other.

13. An image forming system comprising:

a sheet feeding apparatus including:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller; and an image forming apparatus which forms an image on a sheet fed by the sheet feeding apparatus;

wherein a pulley is arranged between the multiple belts at the central part of the third roller, and wherein when a distance between an end surface position at a center part of the third roller of the belt and a position of a dividing wall of the air suction section in an axial direction of the third roller is denoted by B, and a difference in height of the outer surface of the belt between a height of the outer surface of the belt at a position of the pulley side of the belt and a height of the outer surface of the belt at a dividing wall position of the air suction section is denoted by s, a ratio of s to B satisfies the following formula:

$$1/10 \geqq s/B > 1/40.$$

14. An image forming system comprising:

a sheet feeding apparatus including:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller; and an image forming apparatus which forms an image on a sheet fed by the sheet feeding apparatus;

wherein a pulley is arranged between the multiple belts at the central part of the third roller, and an outer surface of the pulley projects from an outer surface of the belt.

15. An image forming system comprising:

a sheet feeding apparatus including:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller; and an image forming apparatus which forms an image on a sheet fed by the sheet feeding apparatus;

wherein a projecting member, which projects from an outer surface of the belt and is located between the multiple belts, is arranged downstream of the third roller in the conveyance direction.

16. The image forming system described in the claim 15, wherein a dividing wall of the air suction section is formed in such a shape that avoids the projecting member.

17. An image forming system comprising:

a sheet feeding apparatus including:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller; and an image forming apparatus which forms an image on a sheet fed by the sheet feeding apparatus;

wherein a dividing wall of the air suction section at a first roller side is formed so as to become more depressed with distance from a corner of the dividing wall to a central portion of the dividing wall.

18. An image forming system comprising:

a sheet feeding apparatus including:

a sheet loading table for loading a stack of sheets; and an adsorption conveyance section comprising:

multiple belts which are located above the sheets loaded on the sheet loading table and in which a plurality of through-holes are formed; and an air suction section which is located in an inside of the belts and absorbs air through the through-holes;

wherein the adsorption conveyance section sucks air by the air suction section, allows the sheet to be adsorbed to the belt, and conveys it in a conveyance direction;

the adsorption conveyance section further comprises: a first roller which is arranged at the inside of the belts and provides driving force to the belts; a second roller which is arranged at the inside of the belts and rotated by the belts, and a third roller which is arranged at the inside of the belts and between the first roller and the second roller in the conveyance direction and rotated by the belts, and the belts are stretched and supported by the first roller, the second roller and the third roller; and an outer surface of the belts mostly protrudes towards the stack of sheets loaded on the sheet loading table at a central part of the third roller in a cross section perpendicular to the conveyance direction containing a shaft of the third roller; and an image forming apparatus which forms an image on a sheet fed by the sheet feeding apparatus;

wherein the sheet feeding apparatus further comprises a blower unit which blows air in a direction from a downstream of the third roller in the conveyance direction of the sheet of paper to the third roller, and, in the blower unit, multiple ribs and multiple air blower paths between the multiple ribs are formed, and a height of a lowest position of a bottom surface of an air blower path among the multiple air blower paths that opposes the central part of the third roller is lowered than a bottom surface of an air blower path adjoining to the air blower path among the multiple air blower paths.

* * * * *